US006681094B2

(12) United States Patent
Horrall et al.

(10) Patent No.: US 6,681,094 B2
(45) Date of Patent: Jan. 20, 2004

(54) INTERMEDIATE TRANSFER MEMBER BELT/ROLLER CONFIGURATION FOR SINGLE-PASS COLOR ELECTROPHOTOGRAPHIC PRINTER

(75) Inventors: Paul Douglas Horrall, Lexington, KY (US); Kurt Matthew Korfhage, Shelbyville, KY (US); Matthew Lowell McKay, Lexington, KY (US); Mark Andrew Omelchenko, Lexington, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 29 days.

(21) Appl. No.: 09/971,195

(22) Filed: Oct. 4, 2001

(65) Prior Publication Data

US 2003/0068179 A1 Apr. 10, 2003

(51) Int. Cl.[7] ..... G03G 15/01

(52) U.S. Cl. ..... 399/299; 399/101; 399/302; 399/313

(58) Field of Search ..... 399/66, 101, 237, 399/297, 299, 302, 313, 315, 316, 397, 400

(56) References Cited

U.S. PATENT DOCUMENTS

| | | | |
|---|---|---|---|
| 4,367,493 | A | 1/1983 | Matteson |
| 4,931,839 | A | 6/1990 | Tompkins et al. |
| 5,119,140 | A | 6/1992 | Berkes et al. |
| 5,132,743 | A | 7/1992 | Bujese et al. |
| 5,187,526 | A | 2/1993 | Zaretsky |
| 5,227,851 | A | 7/1993 | Yoshida et al. |
| 5,233,395 | A | 8/1993 | Kohyama |
| 5,243,392 | A | 9/1993 | Berkes et al. |
| 5,287,160 | A | 2/1994 | Dastin et al. |
| 5,376,999 | A | 12/1994 | Hwang |
| 5,406,359 | A | 4/1995 | Fletcher |
| 5,583,903 | A | 12/1996 | Saito et al. |
| 5,585,903 | A | 12/1996 | Mammino et al. |
| 5,655,199 | A | 8/1997 | Yamashita et al. |
| 5,666,622 | A | 9/1997 | Harasawa et al. |
| 5,701,566 | A | 12/1997 | Bisaiji et al. |

(List continued on next page.)

*Primary Examiner*—Hoang Ngo
(74) *Attorney, Agent, or Firm*—Frederick H. Gribbell; John A. Brady

(57) ABSTRACT

A single-pass color electrophotographic printer includes four imaging stations, yellow, cyan, magenta, and black, on a generally linear path. A toned image in each toner color is developed on an image bearing member or photoconductive drum. A plurality of electrically biased first transfer rollers associated with each imaging station is operative to transfer the developed images from the photoconductive drum to an intermediate transfer member (ITM) belt that travels sequentially past the imaging stations along the generally linear path in a first transfer operation. The image on the ITM belt is transferred to media at a second transfer operation at which the ITM belt passes through a nip between a backup roller and a further electrically biased transfer roller. A servo operation is used to set the voltages on the transfer rollers. Rollers at the second transfer are positioned to direct media downwardly out of the nip to a media transport belt and to a fuser assembly. A reverse roller is provided downstream of the second transfer operation to shift the path of the ITM belt away from the media guide plate and media transport belt. The ITM belt is formed of a resistive material having a uniform thickness and high tensile modulus.

58 Claims, 3 Drawing Sheets

U.S. PATENT DOCUMENTS 5,713,066 A 1/1998 Takekoshi et al.
5,728,496 A 3/1998 Rimai et al.
5,742,888 A 4/1998 Fuchiwaki et al.
5,745,829 A 4/1998 Gazit et al.
5,893,022 A * 4/1999 Yoshino et al. ..... 399/397
6,044,243 A * 3/2000 Hara ..... 399/302
6,198,897 B1 3/2001 Ream
6,226,465 B1 5/2001 Funatani
6,243,555 B1 * 6/2001 Herrick et al.
6,353,721 B1 * 3/2002 Yamaguchi et al. ..... 399/237
6,377,771 B1 * 4/2002 Verluyten et al. ..... 399/302
6,567,633 B2 5/2003 Burdick et al.

* cited by examiner

INTERMEDIATE TRANSFER MEMBER BELT/ROLLER CONFIGURATION FOR SINGLE-PASS COLOR ELECTROPHOTOGRAPHIC PRINTER

BACKGROUND OF THE INVENTION

The field of electrophotographic (EP) printers, particularly those intended for an office environment, is actively migrating from mono (single color, i.e., black) printers to color printers. In a known type of color EP printer, four stations associated with four colors, yellow, magenta, cyan, and black, are provided. Each station includes a laser printhead that is scanned to provide a latent image on the charged surface of a photoconductive (PC) drum. The latent image on each drum is developed with the appropriate color toner and transferred onto an intermediate transfer member (ITM) belt. The image is accumulated on the belt by passing each of the four color stations in turn. In another known type of color EP printer, each color image is developed separately on a single PC drum and accumulated on the ITM belt by making four passes past the PC drum. From the ITM belt, the image is transferred to a media substrate such as paper or a transparency. In another known type of color EP printer, a sheet of media is carried on a belt past the four stations and the image is accumulated directly on the media substrate. The toner on the substrate is then fused to the substrate in a fuser assembly, and the substrate is transported out of the printer.

BRIEF SUMMARY OF THE INVENTION

The present invention relates to a single-pass color electrophotographic printer comprising at least two and preferably four imaging stations disposed to define a generally linear path. Preferably, four imaging stations for the toner colors yellow, cyan, magenta, and black are provided. Each imaging station includes an image bearing member, which may be a photoconductive (PC) drum, an optical source such as a laser assembly operative to produce latent images on the image bearing member, a toner source, and a developing member operative to produce developed toned images from the latent image on the image bearing member. An electrically biased first transfer roller is associated with each imaging station. The transfer rollers, which are disposed adjacent to each image bearing member, are operative in conjunction with the image bearing member upon application of the appropriate voltages to transfer toner from the image bearing member to a substrate passing through the nip between the image bearing member and the transfer roller. Servo operations are used to set the operating voltages on each of the rollers at first transfer.

In the present invention, the substrate is an intermediate transfer member (ITM) belt that travels in an endless loop to sequentially contact the image bearing members for transfer of the toned image thereto, in a first transfer operation. In a second transfer operation, the image on the ITM belt is then transferred to the desired media as the belt and the media together pass through a nip between a second electrically biased transfer roller and a backup roller. A servo operation is again used to set the operating voltages on the second transfer roller.

A media guide plate directs media out of the nip between the backup roller and the second transfer roller to a fuser assembly. A media transport belt may be provided between the media guide plate and the fuser assembly if the distance to the fuser assembly is too great for the media to pass unaided.

The ITM belt is supported by at least a first or drive roller and a second or tension roller disposed inside the belt at opposite ends of the generally linear path past the color imaging stations. The backup roller, which is also located on the inside of the belt off the generally linear path, serves as a third support roller for the ITM belt. Preferably, the ITM belt is also supported by a reverse roller downstream of the second transfer operation on the outside of the belt to shift the path of the ITM belt away from the media guide plate and media transport belt.

The ITM belt is formed of a resistive material having a uniform thickness and a high tensile modulus. The bulk resistivity of the belt ranges from $10^7$ to $10^{12}$ ohm-cm, preferably about $10^{10}$ ohm-cm. The thickness should be as uniform as possible, because variations in thickness cause variations in the velocity of the belt as it travels over the rollers, leading to misregistration of the images on the belt. A nominal thickness of 150 $\mu$m has been found to be satisfactory, because this thickness provides adequate tensile strength and can be controlled to within $\pm 20$ $\mu$m, which is an acceptable tolerance.

The color EP printer of the present invention provides robust performance and good color print quality in a single-pass implementation.

DESCRIPTION OF THE DRAWINGS

The invention will be more fully understood from the following detailed description taken in conjunction with the accompanying drawings in which.

DETAILED DESCRIPTION OF THE INVENTION

Figure 1:
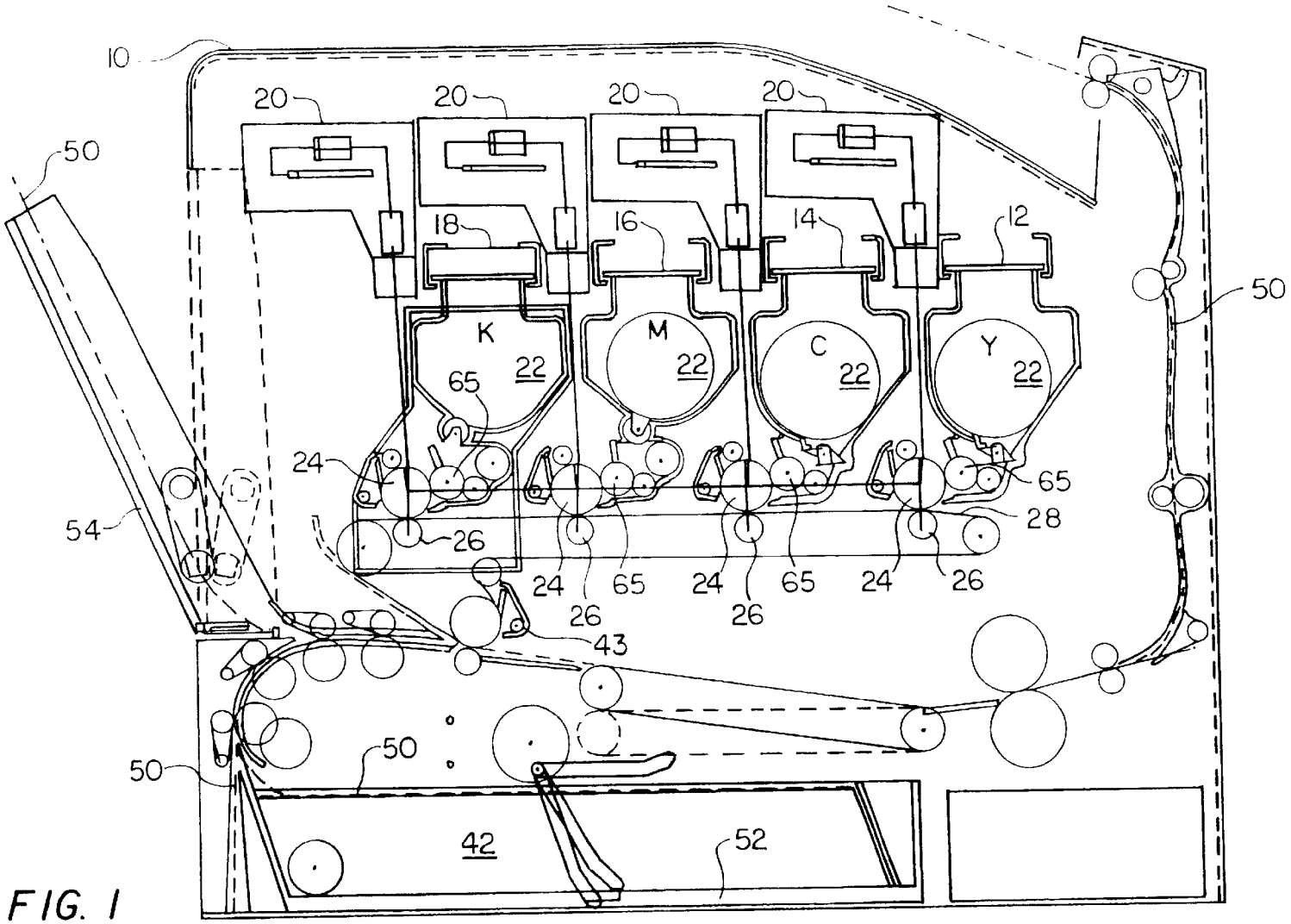
FIG. 1 is a side view of a color electrophotographic printer with a single-pass intermediate transfer member belt according to the present invention.
Figure 2:
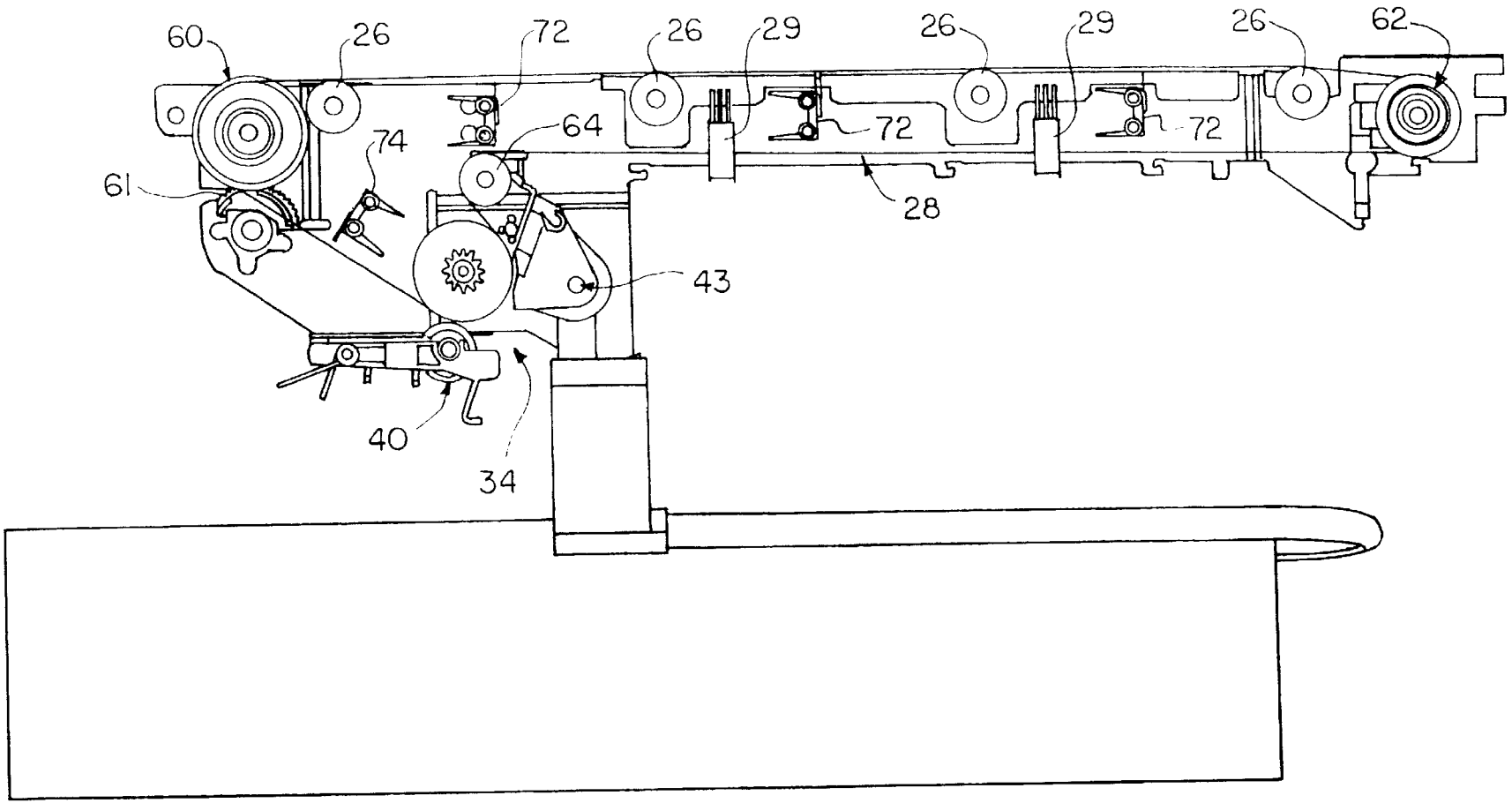
FIG. 2 is a side view of the intermediate transfer member belt assembly of FIG. 1.
Figure 3:
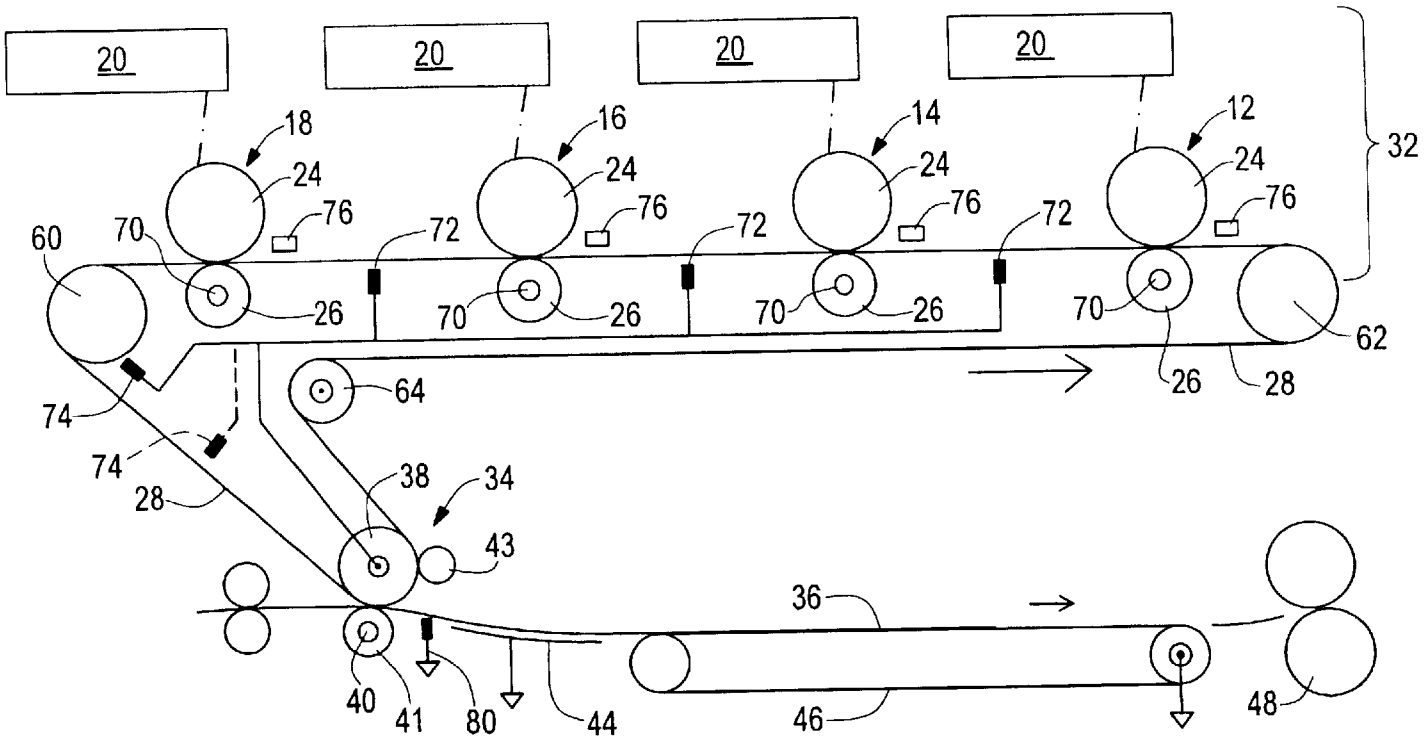
FIG. 3 is a schematic view of the intermediate transfer member belt assembly of FIG. 1.

Referring to FIGS. 1 through 3, the color electrophotographic (EP) printer 10 includes four color stations 12, 14, 16, 18 for the four colors, yellow (Y), cyan (C), magenta (M), and black (K) that are typically used in color printing. Each color station includes a laser printhead 20 and associated toner supply 22. Each color station also includes a rotatable photoconductive (PC) drum 24 having a chargeable and dischargeable photoconductive surface layer. An image is developed on each PC drum in a manner known in the art. An electrically biased transfer roller 26 is provided in association with each PC drum. An intermediate transfer member (ITM) belt 28 travels in an endless loop through the nip between each PC drum 24 and transfer roller 26, and the image developed on the PC drum is transferred to the ITM belt by an electrically-biased roll transfer operation, the first transfer operation, discussed more fully below. The four PC drums and transfer rollers constitute a first transfer assembly 32 (see FIG. 3).

A second transfer assembly 34 is provided at which the image on the ITM belt 28 is transferred to a media substrate 36. The second transfer assembly includes a backup roller 38, on the inside of the ITM belt, and a transfer roller 40. Substrate media, such as paper, cardstock, labels, or transparencies, are fed from a media supply 42 in registration with the image on the ITM belt through the nip between the backup roller 38 and transfer roller 40 of the second transfer assembly 34. The image is transferred from the ITM belt to the substrate, in a manner discussed more fully below. Thereafter, the substrate passes over a guide plate 44 and media transport belt 46 to a fuser assembly 48, where the toner is fused to the substrate. The substrate is then transferred out of the printer or, in duplex printing operations, returned back to the second transfer assembly for transfer of a subsequent image onto the other side of the substrate.

The path 50 taken by the media in the printer embodiment described is illustrated schematically by a dashed line in FIG. 1. It will be appreciated that other printer configurations having different media paths may be used. The media supply may include any one or more of the various types of media supply known in the laser printer field, such as one or more trays 52 from which single sheets of media are automatically fed, manual feed trays 54, or the like.

The ITM belt 28 is supported by at least three and preferably four rollers for travel in an endless loop, as indicated in FIGS. 2 and 3. Position sensors 29 are provided along the length of the belt. In the embodiment illustrated, the belt travels in the counterclockwise direction during printing, but could transiently travel in the clockwise direction during startup or shutdown. In color printing operations, the belt preferably travels first past the yellow, then the cyan, then the magenta, and last the black toner stations. A drive roller 60 and drive coupling gear 61 are provided at one end of the first transfer assembly, and a tracking and tension roller 62 is provided at the other end. It will be appreciated that the locations of these rollers could be switched. The tension roller is used to maintain tension on the belt over the life of the ITM belt assembly. The tension roller is preferably triboelectrically neutral to avoid charge generation on either the roller or the belt. The tension roller is also electrically isolated to prevent interaction with the adjacent color transfer station. The ITM belt is also supported by the backup roller 38 that forms part of the second transfer assembly and preferably by a reverse roller 64. The reverse roller is located on the outer surface of the belt and reverses the curvature of the belt, which moves the belt away from the media substrate path exiting from the second transfer assembly. This shift of the belt path allows operator access to the area below the belt to clear paper jams if necessary. The reverse roller is also electrically grounded and has good toner release characteristics. Electrically, this conductive roller assists in resetting the belt to a neutral electrical condition prior to the next revolution through the process. This roll is an uncoated, nickel-plated aluminum roller in the preferred embodiment. Optionally, a coating may be placed on this roller to improve toner release characteristics. This negates the electrical reset function unless the coating is also made electrically resistive, for instance by adding carbon black to a fluoropolymer coating.

The ITM belt 28 is formed of a resistive material having a uniform thickness and a high tensile modulus. The bulk resistivity of the belt ranges from $10^7$ to $10^{12}$ ohm-cm, preferably about $10^{10}$ ohm-cm. Bulk resistivity is measured using a HiResta HR probe at a test voltage of 100 volts with the belt pressed between the probe and a grounded plate covered with conductive rubber. The thickness should be as uniform as possible, because variations in thickness cause variations in the velocity of the belt as it travels over the rollers, leading to misregistration of the images on the belt. A nominal thickness of 150 $\mu$m (6 mils) has been found to be satisfactory, because this thickness yields adequate tensile strength using preferred belt materials and can be controlled to within ±20 $\mu$m, which is an acceptable tolerance. Thicker belts tend to have greater variation in thickness. Thinner belts tend to have a lower tensile strength. A high tensile modulus, preferably at least 100,000 psi, is desirable to limit changes in the length of the belt as the belt tension changes dynamically and from color station to color station.

The surface resistivity of the belt ranges from $10^7$ to $10^{12}$ Ohms/square, and a preferred range is about $10^8$ to $10^{11}$ Ohms/square. Surface resistivity is measured using a HiResta HA probe at a test voltage of 500 volts with the belt pressed between the probe and an insulating support plate. The belt should exhibit an initial surface roughness in the range from 0.1 to 2.0 microns Ra, according to the DIN 4768 standard. The preferred specification for a maximum surface roughness is about 0.7 microns Ra. This is an initial roughness specification, and surface roughness may change over use.

A suitable ITM belt may be made from a web of a tetrafluoroethylene/ethylene copolymer (E/TFE), such as TEFZEL®, manufactured by DuPont. The E/TFE is loaded with a material such as carbon black to give it the desired resistivity. A loading of 15 to 16 weight percent of submicron-sized particles of acetylene black well dispersed throughout the polymer matrix has been found to be suitable. Other matrix materials may also be used, such as polycarbonate, a fluorocarbon elastomer or a polyimide such as KAPTON®, manufactured by DuPont. Because of its higher tensile modulus, the thickness of a polyimide belt can be decreased to nominally 80 $\mu$m while retaining improved tensile strength and thickness control as compared to E/TFE. Other materials that use ionic conductive agents to make the belt conductive may also be used.

In operation to transfer toner from the PC drum 24 to the ITM belt 28 at the first transfer assembly 32, the rotating PC drum surface is charged by a charging assembly. Portions of the drum surface are selectively discharged by the optical energy from a laser 20, LED array, or the like. Toner is transferred to the drum as determined by the pattern of charge on the drum and developed by a developing assembly 65. The developed toner is then transferred to the ITM belt 28 at the nip between the PC drum 24 and the transfer roller 26. To effect the movement of the toner to the ITM belt, a high voltage power supply 68 is electrically connected to each transfer roller shaft 70 to apply a voltage to the transfer roller opposite in polarity to the charge on the toner. To aid in the transfer of the toner, a velocity variation between the PC drum and the ITM belt is utilized to agitate the toner and improve the transfer efficiency. The velocity variation is preferably approximately 0.5 to 2.5%. All operations are controlled by any suitable controller.

In the preferred embodiment, each PC drum 24 is typically formed with a metal core, preferably of aluminum, maintained at a preselected potential, for example, −200 V. The core is coated with a multi-layer organic photoconductive material. The transfer roller 26 is typically formed from a urethane foam with a conductive agent therein, such as an ionic salt. The nip width between the transfer roller and the ITM belt is approximately 0.5 to 2.0 mm. The nip width between the ITM belt and the PC drum is approximately 0.2 to 0.5 mm. The normal force between the PC drum and the transfer roll is in the range of about 1.2 to 2.13 N, and is preferably about 1.6 N. For a transfer roller length of 21.7 cm, the normal force per unit length would preferably be about 7.5 g/cm, and would fall within a range of about 5.6 g/cm to 10 g/cm. This force is generally less than the force between the PC drum and transfer roller when transferring the image to the media substrate, because the ITM belt material is smoother than typical media substrates. A higher force is needed to force toner into contact with the rougher media substrate.

In the preferred embodiment, the PC drum 24 has a diameter of 30 mm and the coating has a thickness of 27 $\mu$m. The capacitance of the PC drum may range from 90 pF/cm$^2$ to 150 pF/cm$^2$. The surface potential may range from −260 V to −1050 V. The transfer roller 26 in the preferred embodiment is 16.92 mm in diameter and is mounted on an 8 mm shaft. The resistivity is typically $10^9$ ohm-cm. The transfer roller has a hardness of 45 to 60 Shore 00 durometer. The voltage may range from −200 V to +3000 V during printing and −600 V during cleaning. Optionally, a 10 $\mu$m protective coating of a material having a resistivity of $10^8$ to $10^9$ ohm-cm, such as a carbon-loaded nylon, may be provided on the roller. This coating is not necessary, however, because the ITM belt intervening between the PC drum and the transfer roller also serves to protect the transfer roller from toner contamination.

A high voltage power supply (HVPS) 68 is electrically connected to each transfer roller shaft 70. The voltage range of the high voltage power supply is typically −600 V to +3000 V. This voltage range is less than the voltage range for high voltage power supplies used with mono EP printers or in color printers that transfer directly to print media (typically −1350 to +4700 V), because the electrical properties and thickness of the ITM belt are well controllable, in contrast to the transfer operation onto media substrates.

Figure 4:
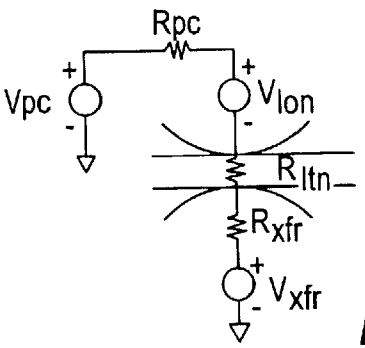
FIG. 4 is a diagram of the electrical circuit of the first transfer assembly of the present invention.

A transfer servo operation is performed prior to printing to establish an initial or "servo" voltage. The voltage on the PC drum entering the transfer nip is maintained at a controlled potential, $V_{pc}$, nominally −500 V, during the servo operation. The servo voltage is determined as that voltage which delivers a fixed current, for example, 8 $\mu$A nominal, from the HVPS 68 to the transfer roll shaft (see FIG. 4). The servo voltage varies with the environment, based on transfer roller resistivity and other environmental factors, such as Paschen breakdown voltage, $V_{ion}$, or PC drum voltage.

The resulting transfer servo voltage is used as the basis for setting the transfer HVPS voltage for the subsequent printing operation. The transfer "image" voltage is based upon a monotonic, piece-wise linear relationship to the servo voltage. Each color PC drum/transfer roller has a relationship between servo and image voltage based upon roller, belt, PC capacitance, process speed and toner characteristics. Individual relationships and individual transfer power supplies 68, are provided for each color station in the present case, to allow for differences in toner layer thickness and toner charge properties.

An "inter-image" transfer voltage is also determined for each of the color stations from the respective transfer "servo" voltage. The "inter-image" transfer voltage provides a slight positive current flow from the transfer roller to the PC drum between images.

The ITM belt 28 is nominally neutral in charge as it enters the first color PC/transfer roller nip. However, it may have a triboelectrically generated charge from the feed process or a slight residual charge remaining from a previous revolution. Charged areas on the PC drum are at nominally −950 V and discharged (toner-covered) areas at nominally −300 V. The PC drum core is at −200 V.

When the leading edge of the PC image arrives at the nip between the PC drum 24 and the transfer roller 28, the transfer "image" voltage is applied to the transfer roller shaft 70. Immediately prior to the end of the PC image exiting the nip, the transfer "inter-image" voltage is applied to the transfer roller shaft. This timing applies the transfer "image" voltage only to the image areas of the PC drum. Non-imaged areas see only the "inter-image" transfer voltage that is set to minimize toner transfer and to avoid excess current flow. The transfer voltage is set to the "clean" potential during run-in, run-out, and other periods of extended run when negative toner may be present on the transfer belt.

In the case of a conductive ITM belt or when the transfer high voltage power supply is shared among a plurality of first transfer rolls, the timing is modified so that the transfer "image" voltage is simultaneously applied to the transfer roller shafts 70 when the leading edge of the PC image arrives at the first of the plurality of nips between the PC drum 24 and the transfer roller 28. When the end of the PC image exits the last of the plurality of transfer nips, the transfer "inter-image" voltage is simultaneously applied to the plurality of transfer roller shafts 70.

The belt exiting each transfer nip may be partially discharged by discharge brush assemblies 72 located approximately midway to the next color station transfer nip. The discharge brush is typically formed from stainless steel, carbon-loaded nylon, or carbon-loaded polyester fibers. Fiber bundles are spaced approximately 5 mm along the length of the brush, and the fiber tips are approximately 1 mm from the inside of the ITM belt. The discharge brush is tied to a negative potential of nominally −600 V in the preferred implementation, with a conduction threshold of nominally 1000 V. The ITM belt is thus reset to a controlled initial condition prior to the subsequent transfer operation. Excessive residual charge is removed by uniformly distributed conduction via Paschen breakdown to the brush fiber tips. The −600 V brush potential offsets the 1000 V conduction threshold, resulting in a belt potential (in the vicinity of the discharge brush) of nominally +400 V. The measured potential is dependent upon both initial charge and residual charge levels and the distance to surrounding conductors.

After the final color station 18 (black in the preferred embodiment), a discharge brush assembly 74 is located in a spaced relationship with the belt drive roller 60, which is covered with an electrically resistive coating ranging from $10^7$ ohm-cm to $10^{11}$ ohm-cm. The roller is electrically isolated to avoid interaction with the nearby black transfer station. In the preferred embodiment, the drive roll has a diameter of 32.0 mm for a spacing between imaging stations of 101 mm and an ITM belt thickness of 150 $\mu$m. Discharge brush 74 provides an electrical path with the 1000 V conduction threshold typical of a 1 mm gap. The brush is tied to −600 V to partially offset the magnitude of the 1000 V conduction threshold. In the preferred embodiment, the discharge brush 74 is located facing the ITM belt downstream of the drive roller rather than in the optional 1 mm spaced relationship to the drive roller.

An optional erase lamp 76 (FIG. 3) may be used to partially discharge each PC drum by 100 to 600 V in areas not covered with toner. This reduces the likelihood of pre- and post-nip air ionization and consequent toner disturbances that affect print quality and transfer of toner from the ITM belt back to a PC drum. An erase lamp is not necessary, however, due to the lower transfer voltages needed for transfer to the controlled ITM belt. If an erase lamp is desired, it may be located either behind a translucent ITM belt or in the space between the ITM belt and the bottom of the print cartridge.

The ITM belt transporting the composite color image acquired at each of the four color stations is then advanced toward the second transfer station 34 with the controlled residual charge remaining from the final brush-discharge.

The backup roller 38 at the second transfer station is an uncoated metal roller, preferably nickel-plated aluminum, with an applied bias of −100 V. The transfer roller 40 is a coated roller similar to the transfer rollers discussed above. The force between the transfer roller and the backup roller is sufficient to transfer toner to rough print media. An erase lamp is not necessary, because the ITM belt is not a photoreceptor. The voltage difference between toned and untoned areas is already low as a result of the upstream discharge brush and because the belt, unlike the photoconductor at each first transfer, was not negatively charged. A toner cleaner assembly 43 is provided adjacent the backup roller on the opposite side of the ITM belt. The cleaner presses against the belt and the backup roller to scrape residual toner from the ITM belt. The toner cleaner may be similar to those used to clean the PC drums if desired. Alternatively, a brush cleaner with associated scavenger roll, blade cleaner, and electrical biases, as is well known in the art, may be used to prolong transfer belt life. Preferably, the reverse roller 64 is located to wrap a sufficient length of the ITM belt around the backup roller to provide access by the cleaner assembly 43.

In the preferred embodiment, the backup roller 38 has a diameter of 32 mm for a spacing between imaging stations of 101 mm and an ITM belt thickness of 150 $\mu$m. The transfer roller 40 has a diameter of 19.0 mm on an 8 mm shaft 41. The transfer roller is formed from a urethane foam with a conductive agent therein. The resistivity is $10^9$ ohm-cm with a carbon-loaded nylon 10 $\mu$m coating with resistivity of $10^8$ to $10^9$ ohm-cm. The hardness is 50 to 60 Shore 00 durometer. The transfer roller applies approximately a 20 N normal force on the backup roller. The nip width is approximately 2.5 mm. The voltage ranges from −200 to +4700 volts during image transfer and −600 volts during cleaning.

In operation, a transfer servo operation is performed prior to printing to establish the transfer HVPS voltage required to deliver a fixed current, 8 $\mu$A nominal, from the HVPS to the transfer roller shaft. The voltage on the backup roller is maintained at a controlled potential during this servo operation, nominally −600 V. The servo voltage varies with the environment, based on transfer roller resistivity and other environmental factors, such as Paschen breakdown voltage and belt resistivity.

The resulting transfer "servo" voltage is used as the basis for setting the transfer HVPS voltage for the subsequent printing operation, based upon the media type, which may be selected either by an operator or the print driver. The transfer "print" voltage is based upon a monotonic, piecewise linear relationship to the servo voltage. Thin media typically require lower transfer voltages and thick media higher transfer voltages. Highly resistive media such as transparencies require a different transfer voltage than conductive media, such as wet paper. An "inter-page" transfer voltage is also determined. The "inter-page" transfer voltage provides a slight positive current flow from the transfer roller to the ITM belt and the backup roller between images to prevent the transfer of background toner to the transfer roller.

The ITM belt 28 enters the second transfer assembly 34 with a residual positive charge from the final pre-transfer brush discharge electrode 74. The majority of this residual charge is conducted to the second transfer backup roller 38 when the ITM belt contacts that roller. When the leading edge of the ITM image arrives at the second transfer roller nip, coincident with the leading edge of the print media, the transfer "print" voltage is applied to the transfer roller shaft. When the ITM image exits the nip, coincident with the trailing edge of the print media, the transfer "inter-page" voltage is applied to the transfer roller shaft. This timing applies the transfer "print" voltage only to the image areas of the ITM belt. Non-imaged areas see only the "inter-image" transfer voltage, which is set to minimize toner transfer and to avoid excess current flow. Toned and untoned areas of the ITM belt are at approximately the same potential. The transfer voltage is set to the "clean" potential during run-in, run-out, and other periods of extended run when negative toner may be present on the transfer belt.

To aid in the transfer of the toner at first transfer, a velocity variation between the ITM belt and the PC drum is utilized. Preferably, the variation is approximately 0.5 to 2.5%, which agitates the toner and improves the transfer efficiency. In the preferred embodiment, at first transfer, the transfer belt overdrives the PC drums by 1.0%, and at second transfer, the media/transfer roller match the surface velocity of the transfer belt. The drive applied to the transfer roll at second transfer minimizes the effect of media speed, including nip shock, on the speed of the ITM belt. The key feature is the relative velocity between the input and output EP elements at first and second transfer, and that the velocity variation can be applied in either direction.

The substrate 36 exits the transfer nip onto the media guide plate 44. The guide plate is grounded and is formed of a resistive polycarbonate having a resistivity of $10^6$ to $10^9$ ohms per square. The guide plate also has a ribbed configuration.

The substrate exiting the transfer nip is partially discharged by a discharge brush 80 located downstream of the transfer nip. This discharge brush is grounded, with a conduction threshold of nominally 1000 V. Thus, a substrate that has excessive residual charge is relieved of that excess charge by uniformly distributed conduction via Paschen breakdown to the brush fiber tips. The brush is preferably of stainless steel, carbon-loaded nylon, or carbon-loaded polyester fibers. Fiber bundles are spaced approximately 5 mm along the length of the brush. Fiber tips are approximately 1.5 mm from the media $^{\pm}$1.5 mm, depending on the media trajectory.

The substrate 36 exits the transfer nip at an angle of approximately −10 to −15°, or 10 to 15° below horizontal, to the resistive, ribbed media guide plate 44. This angle is established by the angle at which the transfer roller contacts the backup roller in combination with the relative stiffnesses of the transfer roller foam and the print media. Horizontal transfer of the substrate out of the nip between the backup roller and the transfer roller would result in an undesirable upward trajectory for the substrate exiting the nip and would lead to problems with electrostatic levitation in which the substrate would be too far from the discharge brush 80 to be effectively discharged. The substrate would also be too far from the media guide plate to be electrostatically held down. The media would then be attracted to the nearest surface or may levitate unpredictably. To avoid this problem, the transfer roller contacts the backup roller at a location slightly removed in the clockwise direction from a location directly vertically below the backup roller, as illustrated in FIGS. 2 and 3.

The substrate is then guided by the guide plate from the second transfer nip to a media transport belt 48 comprising one or more parallel belts that carries the substrate to a fuser assembly. The residual charge on the substrate is too low to generate Paschen breakdown to the grounded guide plate. For resistive media, the residual charge is, however, high enough to result in an electrostatic hold-down force arising from the image charge induced in the guide plate. The transport belt is a carbon-loaded EPDM or other resistive polymer. The electrical characteristics of the transport belt are similar to those of the media guide plate, for example, a resistivity of $10^6$ to $10^9$ ohms per square. The belt is provided with a ground path by scrubbing contact to the underlying electrically grounded vacuum plenum or alternatively by one of the conductive drive rollers on which it rides. The substrate is attracted to the belt electrostatically via image charge and, in the preferred embodiment, also by vacuum. The belt is needed because the distance from the second transfer nip to the fuser assembly is greater than the length of the shortest allowable print media. It will be appreciated that, if the fuser assembly were closer to the exit of the second transfer assembly, the media transport belt may be omitted.

The substrate then enters the fuser assembly, which must have an electrical design capable of handling the toned and partially charged media without disturbing the toned image. A short guide plate bridges the gap between the media transport belt and the entrance to the fuser assembly. The electrical characteristics of this guide plate are not critical. Preferably, however, the guide plate is resistive and electrically grounded.

It will be appreciated that the various parameters of the preferred embodiment shown and described above may be varied as appropriate by those of skill in the art for a particular printer design. The invention is not to be limited by what has been particularly shown and described, except as indicated by the appended claims.

What is claimed is:

1. A single-pass color electrophotographic printer comprising:

at least two imaging stations disposed to define a generally linear path, each imaging station including an image bearing member;

an intermediate transfer member comprising a belt disposed to travel in an endless loop and to sequentially pass the plurality of imaging stations along the generally linear path, the belt supported by at least a first roller and a second roller disposed at opposite ends of the generally linear path, the belt further supported by a third roller located off the generally linear path;

a plurality of electrically biased first transfer rollers, each first transfer roller associated with and disposed on an opposite side of the belt from each imaging station and operative to transfer developed images from the image bearing members to the intermediate transfer member belt, the intermediate transfer member belt passing through a nip between each first transfer roller and associated imaging station;

an electrically biased second transfer roller operative to transfer developed images from the intermediate transfer member to media substrates, the second transfer member disposed on an opposite side of the belt from the third roller, the intermediate transfer member belt passing through a first nip between the second transfer roller and the third roller; and a cleaning station disposed on an opposite side of the belt from said third roller at a location different than said second transfer roller, the intermediate transfer member belt passing through a second nip between the cleaning station and the third roller, said cleaning station operative to remove from said transfer belt at least a portion of image forming material which remains after passing through said first nip between the second transfer roller and the third roller;

wherein said third roller performs two separate mechanical functions: (a) to act as a backup roller for said second transfer roller; and (b) to act as a backup roller for said cleaning station.

2. The printer of claim 1, wherein the at least two imaging stations comprise four imaging stations, a first imaging station including a yellow toner source, a second imaging station including a cyan toner source, a third imaging station including a magenta toner source, and a fourth imaging station including a black toner source.

3. The printer of claim 1, wherein the belt is supported by a fourth support roller, the fourth support roller located on an outside of the belt to reverse the curvature of the belt.

4. The printer of claim 3, wherein the fourth support roller is electrically grounded.

5. The printer of claim 1, wherein the first roller comprises a drive roller and the second roller comprises a tension roller.

6. The printer of claim 5, wherein the drive roller is located after a last of the imaging stations.

7. The printer of claim 5, wherein the drive roller is electrically isolated from the imaging stations.

8. The printer of claim 5, wherein the tension roller is triboelectrically neutral.

9. The printer of claim 5, wherein the tension roller is electrically isolated from the imaging stations.

10. The printer of claim 1, further comprising a media path passing through the nip between the third roller and the second transfer roller, a media guide plate located on the media path downstream of the nip between the third roller and the second transfer roller.

11. The printer of claim 10, wherein the media guide plate is formed of a resistive material.

12. The printer of claim 10, wherein the media guide plate is electrically grounded.

13. The printer of claim 10, wherein the nip between the third roller and the second transfer roller is arranged to direct media on the media path out of the nip at an angle below horizontal.

14. The printer of claim 13, wherein the angle below horizontal is 10 to 15° below horizontal.

15. The printer of claim 10, further comprising a media transport belt located on the media path downstream of the media guide plate.

16. A single-pass color electrophotographic printer comprising:

at least two imaging stations disposed to define a generally linear path, each imaging station including an image bearing member;

an intermediate transfer member comprising belt disposed to travel in an endless loop and to sequentially pass the plurality of imaging stations along the generally linear path, the belt supported by at least a first roller and a second roller disposed at opposite ends of the generally linear path, the belt further supported by a third roller located off the generally linear path;

a plurality of electrically biased first transfer rollers, each first transfer roller associated with and disposed on an opposite side of the belt from each imaging station and operative to transfer developed images from the image bearing members to the intermediate transfer member belt, the intermediate transfer member belt passing through a nip between each first transfer roller and associated imaging station;

an electrically biased second transfer roller operative to transfer developed images from the intermediate transfer member to media substrates, the second transfer member disposed on an opposite side of the belt from the third roller, the intermediate transfer member belt passing through a nip between the second transfer roller and the third roller;

a media path passing through the nip between the third roller and the second transfer roller, a media guide plate located on the media path downstream of the nip between the third roller and the second transfer roller;

a media transport belt located on the media path downstream of the media guide plate; and a vacuum hold down assembly operative to retain media on the media transport belt.

17. The printer of claim 10, further comprising a fuser assembly located downstream of the media guide plate.

18. The printer of claim 15, further comprising a fuser assembly located downstream of the media transport belt.

19. The printer of claim 1, wherein the image bearing member comprises a photoconductive drum.

20. The printer of claim 1, further comprising a discharge brush located downstream of the nip between the third roller and the second electrically biased transfer roller.

21. The printer of claim 1, wherein the intermediate transfer member belt is formed of a resistive material.

22. The printer of claim 21, wherein the intermediate transfer member belt has a bulk resistivity ranging from $10^7$ to $10^{12}$ ohm-cm.

23. The primer of claim 21, wherein the intermediate transfer member belt has a bulk resistivity of $10^{10}$ ohm-cm.

24. The printer of claim 1, wherein the intermediate transfer member belt has a uniform thickness.

25. The printer of claim 1, wherein the intermediate transfer member belt has a thickness uniform to within ±20 $\mu$m.

26. The printer of claim 1, wherein the intermediate transfer member belt has a thickness of 150 $\mu$m ±20 $\mu$m.

27. The printer of claim 1, wherein the intermediate transfer member belt has a tensile modulus of at least 100,000 psi.

28. The printer of claim 1, wherein the intermediate transfer member belt is formed of a tetrafluoroethylene/ethylene copolymer.

29. The printer of claim 1, wherein the intermediate transfer member belt includes a material selected to provide a desired resistivity.

30. The printer of claim 1, wherein the intermediate transfer member belt includes a conductive material dispersed within the belt and selected to provide a desired resistivity.

31. The printer of claim 1, wherein the intermediate transfer member belt includes carbon black.

32. The printer of claim 1, wherein the intermediate transfer member belt includes sub-micron-sized particles of acetylene black.

33. The printer of claim 1, wherein the intermediate transfer member belt includes 15 to 16 weight percent of acetylene black.

34. The printer of claim 1, wherein the intermediate transfer member belt is formed of a tetrafluoroethylene/ethylene copolymer, a fluorocarbon elastomer, or a polyimide.

35. The printer of claim 1, further comprising a discharge brush located between each imaging station and in spaced relationship to the intermediate transfer member belt and operative to remove excessive residual charge from the intermediate transfer member belt.

36. The printer of claim 1, wherein the generally linear path terminates at the first roller, and further comprising a discharge brush located in spaced relationship with the first roller.

37. The printer of claim 1, further comprising a discharge brush located in spaced relationship with the intermediate transfer member belt after the last of the plurality of imaging stations.

38. The printer of claim 1, wherein said cleaning station is disposed to clean toner from the intermediate transfer member belt at a location downstream of the second transfer roller.

39. The printer of claim 1, further comprising a high voltage power supply associated with each first transfer roller and operative to establish a current from each first transfer roller to the associated image bearing member.

40. A single-pass color electrophotographic printer comprising:

at least two imaging stations disposed to define a generally linear path, each imaging station including an image bearing member;

an intermediate transfer member comprising a belt disposed to travel in an endless loop path and to sequentially pass the plurality of imaging stations along the generally linear path, the belt supported by a first roller and a second roller disposed at opposite ends of the generally linear path, the belt further supported by a third roller and a fourth roller located off the generally linear path, the fourth roller located to reverse the curvature of the belt on a portion of the endless loop path, wherein said reverse belt curvature exhibits an angle greater than 90 degrees;

a plurality of first transfer assemblies, each first transfer assembly associated with each imaging station and operative to transfer developed images from the image bearing members to the intermediate transfer member belt; and a second transfer assembly operative to transfer developed images from the intermediate transfer member to media substrates, the second transfer assembly associated with the third roller.

41. The printer of claim 40, wherein the first transfer assemblies comprise electrically biased first transfer rollers disposed on an opposite side of the belt from each associated imaging station.

42. The printer of claim 40, wherein the second transfer assembly comprises an electrically biased transfer roller disposed on an opposite side of the belt from the third roller.

43. The printer of claim 40, wherein the fourth roller is located downstream along the endless loop path from the third roller.

44. The printer of claim 43, wherein said fourth roller causes a change in direction of belt movement that creates an area of accessibility for removing a paper jam from a region near the third roller.

45. The printer of claim 44, wherein said third roller comprises a backup roller that is proximal to a toner transfer point of said belt.

46. The printer of claim 40, wherein the fourth roller is electrically grounded.

47. The printer of claim 43, wherein said fourth roller causes a change in direction of belt movement that allows a cleaning station to be located at a roller other than a tension roller.

48. The printer of claim 47, wherein said roller other than a tension roller comprises said third roller, and wherein said third roller provides backup support for said belt, and waste toner will fall from said third roller area and away from said belt.

49. A single-pass color electrophotographic printer comprising:

at least two imaging stations disposed to define a generally linear path, each imaging station including an image bearing member;

an intermediate transfer member comprising a belt disposed to travel in an endless loop path and to sequentially pass the plurality of imaging stations along the generally linear path, the belt supported by a first roller and a second roller disposed at opposite ends of the generally linear path, the belt further supported by a third roller located off the generally linear path, wherein said belt exhibits a curvature around said third roller at an angle that is in the range of 135–180 degrees;

a plurality of first transfer assemblies, each first transfer assembly associated with each imaging station and operative to transfer developed images from the image bearing members to the intermediate transfer member belt;

a second transfer assembly operative to transfer developed images from the intermediate transfer member to media substrates, the second transfer assembly associated with the third roller.

50.The printer of claim 49, further comprising: a media guide plate located on a media path downstream of the second transfer assembly, the second transfer assembly arranged to direct media out of the second transfer assembly at an angle below horizontal onto the media guide plate.

51. The printer of claim 50, wherein the angle below horizontal is 10 to 15° below horizontal.

52. The printer of claim 50, wherein the media guide plate is formed of a resistive material.

53. The printer of claim 50, wherein the media guide plate is electrically grounded.

54. The printer of claim 50, further comprising a media transport belt located on the media path downstream of the media guide plate.

55. The printer of claim 54, further comprising a vacuum hold down assembly operative to retain media on the media transport belt.

56. The printer of claim 50, further comprising a fuser assembly located downstream of the media guide plate.

57. The printer of claim 49, further comprising: a cleaning station disposed on an opposite side of the belt from said third roller at a location different than said second transfer roller, the intermediate transfer member belt passing through a second nip between the cleaning station and the third roller, said cleaning station operative to remove from said transfer belt at least a portion of image forming material which remains after passing through a first nip between the second transfer roller and the third roller;

wherein said third roller performs two separate mechanical functions: (a) to act as a backup roller for said second transfer roller; and (b) to act as a backup roller for said cleaning station.

58. The printer of claim 49, further comprising: a fourth roller located off the generally linear path, said belt being further supported by said fourth roller, said fourth roller located to reverse the curvature of the belt on a portion of the endless loop path, wherein said reverse belt curvature exhibits an angle greater than 90 degrees.

* * * * *